US006841522B2

(12) United States Patent
Corner et al.

(10) Patent No.: US 6,841,522 B2
(45) Date of Patent: Jan. 11, 2005

(54) LUBRICANT COMPOSITIONS

(75) Inventors: Mitchell Corner, Redcar (GB); Peter Timothy Gibb, Guisborough (GB); Steven James Randles, Middlesbrough (GB); Robert Ian George Thompson, Redcar (GB)

(73) Assignee: Imperial Chemical Industries PLC, London (GB)

( * ) Notice: Subject to any disclaimer, the term of this patent is extended or adjusted under 35 U.S.C. 154(b) by 0 days.

(21) Appl. No.: 09/843,166

(22) Filed: Apr. 27, 2001

(65) Prior Publication Data

US 2002/0002122 A1 Jan. 3, 2002

Related U.S. Application Data

(63) Continuation of application No. PCT/GB99/03560, filed on Oct. 27, 1999.

(30) Foreign Application Priority Data

Oct. 28, 1998 (GB) ..... 9823455

(51) Int. Cl.[7] ..... C10M 111/02; C10M 111/04
(52) U.S. Cl. ..... 508/495; 508/499; 508/579
(58) Field of Search ..... 508/579, 485, 508/496, 499

(56) References Cited

U.S. PATENT DOCUMENTS 4,175,045 A * 11/1979 Timony ..... 508/485
4,302,343 A 11/1981 Carswell
4,851,144 A * 7/1989 McGraw et al. ..... 508/485
4,968,453 A 11/1990 Wada
RE33,658 E * 8/1991 Ward et al. ..... 508/499
5,580,483 A * 12/1996 Hamid ..... 508/480
5,688,433 A * 11/1997 Kasahara et al. ..... 252/68
6,080,705 A * 6/2000 Kaimai et al. ..... 508/495
6,127,324 A * 10/2000 Tolfa et al. ..... 508/463
6,221,272 B1 * 4/2001 Schnur et al. ..... 252/68
6,248,256 B1 * 6/2001 Nagao et al. ..... 252/68

FOREIGN PATENT DOCUMENTS

EP 0377122 7/1990
EP 0861883 9/1998

OTHER PUBLICATIONS

Smalheer et al, "Lubricant Additives", Section I–Chemistry of Additives, pp. 1–11.*

* cited by examiner

*Primary Examiner*—Ellen M McAvoy
(74) *Attorney, Agent, or Firm*—Pillsbury Winthrop LLP

(57) ABSTRACT

This invention relates to lubricant compositions comprising a polyalkylene glycol and an ester wherein the polyalkylene glycol has the formula (I): $RO—(CH_2CH(CH_3)O)_n—CH_3$ where R is an alkyl group with 1 to 15 carbon atoms and n=1 to 35. The lubricant compositions of the invention do not readily form stable emulsions with water. This feature makes the lubricant compositions of the invention particularly suitable for use with air compressors where it is very difficult to exclude moisture.

6 Claims, No Drawings

LUBRICANT COMPOSITIONS

This is a continuation of International Application No. PCT/GB99/03560 filed Oct. 27, 1999 which designates the U.S., and that International Application was published under PCT Article 21(2) in English.

This invention relates to lubricant compositions, in particular to lubricant compositions for air compressors which comprise a polyalkylene glycol and an ester.

U.S. Pat. No. 4,302,343, and its equivalent EP 17072, disclose lubricant compositions consisting of polyalkylene glycols and esters for use with rotary screw compressors wherein the ester is derived from a hindered polyhydric alcohol. Such lubricant compositions offer benefits over the conventional mineral oil lubricants in terms of thermal and oxidative stability, improved lubricity and increased service intervals. Similar benefits can be reproduced in reciprocating air compressors by using lubricant compositions consisting of polyalkylene glycols and esters where the ester is derived from a monohydric alcohol, examples of which are disclosed in U.S. Pat. No. 4,751,012 and its equivalent EP 227477. The transition from polyhydric- to monohydric-alcohol-derived esters in such lubricant compositions provides a reduction in valve deposit formation advantageous for use with the reciprocating air compressors. In each type of lubricant compositions, the polyalkylene glycol is end capped with either hydrogen or a low molecular weight hydrocarbon.

Alternative lubricant compositions consisting of lower-alcohol-initiated propoxylates or polypropylene glycol combined with an aviation-type neopentyl polyol ester (for example a tetra ester of pentaerythritol with monoacids of carbon numbers C5–C9 or a trimethylol polyol ester) or diacid ester which are available commercially perform well across a range of performance criteria such as low temperature fluidity and foaming tendency.

However, there are problems with these commercial products as they have a tendency to form stable emulsions when mixed with water. In practice, the formation of such emulsions is unavoidable unless air compressors are run in perfectly dry air conditions, owing to the moisture in the air condensing out. The formation of the emulsion can affect both the lubrication performance and the ability to measure the lubricant level.

Moreover, unlike conventional mineral oils, where the 'condensate' is easily separated from the oil and can be disposed of as water, 'condensate' containing emulsified lubricant is now considered as 'chemical' waste with all the associated costs of disposal.

A further problem can arise if such commercial products are incorrectly added to an air compressor containing mineral oil owing to their low miscibility with mineral oil.

Clearly, the degree to which the lubricant composition takes up water is of great relevance.

It has been found that these problems can be overcome without detrimentally affecting other lubrication properties by using lubricant compositions comprising specific polyalkylene glycols and specific esters.

According to one aspect of the invention there is provided a lubricant composition comprising (1) a polyalkylene glycol having the formula $$RO—(CH_2CH(CH_3)O)_n—CH_3$$

where R is an alkyl group with 1 to 15 carbon atoms and n=1 to 35; and (2) an ester.

In a second aspect of the invention, there is provided a lubricant composition, for use in an air compressor, comprising (1) a polyalkylene glycol having the formula $RO—(CH_2CH(CH_3)O)_n—CH_3$ where R=alkyl group with 1 to 15 carbon atoms and n=1 to 35; and (2) an ester.

The polyalkylene glycol is a methyl end-capped propoxylate which is initiated from a monofunctional alcohol or mixture of monofunctional alcohols, ROH, where R is an alkyl group with 1 to 15 carbon atoms. R may be saturated or unsaturated and may be straight chained or branched. Preferably R is an alkyl group with 1 to 4 carbon atoms and more preferably R is methyl.

The number of propoxylate units, n, in the polyalkylene glycol ranges from 1 to 35, preferably from 8 to 30.

Preferably, the ester is chosen from a polyol ester, an aliphatic diacid ester, an aromatic diacid ester or a trimellitate. Examples of polyol esters are esters of pentaerthyritol. Examples of aromatic diacid esters are phthalates. Examples of aliphatic diacid esters are esters of saturated aliphatic acids, for example glutaric, adipic and sebacic acids. More preferably the ester is chosen from a polyol ester or an aromatic diacid ester.

The lubricant composition preferably comprises a polyalkylene glycol in the range 90–10 weight percent and an ester in the range 10–90 weight percent. More preferably the polyalkylene glycol is in the range 70–30 weight percent and the ester 30–70 weight percent.

The lubricant composition preferably contains an antifoam agent additive at a level of 2–100 ppm. Preferably the antifoam agent does not contain silicone. Other standard lubricant additives may also be present, for example antioxidant and/or anticorrosion agents.

The invention will now be described further with reference to the following examples.

EXAMPLE 1

Tests were carried out using a modified form of ASTM D1401 (a common industry test used as a measure of the demulsibility of lubricant/water mixtures) in which 40 parts by volume of lubricant and 40 parts by volume of water were mixed together, for 5 minutes at 54° C., to form an emulsion and left to stand.

The results, which are shown in Table 1 are based on x-y-z (t) where x is the volume of the oil layer, y is the volume of the water layer, z is the volume of the emulsion layer and t is the time taken, in minutes, to achieve the result; t=5 is the minimum time for the test and so 40-40-0(5) is the ideal result.

All of the lubricant compositions include an additive package of 0.6% commercial antioxidant and anticorrosion agent.

TABLE 1

Demulsibility (ASTM D1401)

| Sample | Ratio of PAG:Ester (Weight Percent) | Result | Oil | Water | Pass/Fail |
|---|---|---|---|---|---|
| 1 | 40:60 | 40-40-0(5) | hazy | clear | Pass |
| 2 | 52:48 | 40-40-0(30) | hazy | clear | Pass |
| 3 | 52:48 | 40-40-0(30) | hazy | clear | Pass |
| 4 | 55:45 | 40-40-0(10) | hazy | clear | Pass |
| 5 | 53:47 | 40-40-0(5) | hazy | hazy | Pass |
| 6 | 90:10 | 40-40-0(5) | hazy | clear | Pass |
| 7 | 70:30 | 43-37-0(30) | hazy | clear | Pass |
| 8 | 90:10 | 40-40-0(5) | hazy | clear | Pass |
| 9 | 70:30 | 38-42-0(30) | hazy | hazy | Pass |
| 10 | 30:70 | 38-42-0(30) | hazy | hazy | Pass |

Samples 1, 2 and 3 are a blend of methanol-initiated methyl-end-capped propoxylate and diisodecyl phthalate. Sample 3 also includes 50 ppm of a non-silicone antifoaming agent, Additin RC 8301 ex Rhein Chemie.

Sample 4 is a blend of methanol-initiated methyl-end-capped propoxylate and di (3,5,5-trimethyl hexyl)phthalate.

Samples 5 and 6 are a blend of methanol-initiated methyl-end-capped propoxylate and a tetra ester of pentaerythritol with 2-ethyl hexanoic acid.

Sample 7 is a blend of methanol-initiated methyl-end capped propoxylate and a tetra ester of pentaerythritol with valeric and heptanoic acids.

Sample 8 is a blend of methanol initiated methyl end capped propoxylate and a diester of isotridecanol and adipic acid.

Samples 9 and 10 are a blend of C13/C15 alcohol-initiated methyl-end capped propoxylate and diisodecyl phthalate.

EXAMPLE 2

Comparative

Example 1 was repeated using lubricant compositions outside the scope of specific blends of polyalkylene glycol and ester of the invention. The results are shown in Table 2 below.

TABLE 2

| Demulsibility (ASTM D1401) | | | | | |
|---|---|---|---|---|---|
| Comparative Sample | Ratio of PAG:Ester | Result | Oil | Water | Pass/Fail |
| 11 | 60:40 | 1-8-71(60) | cloudy | hazy | Fail |
| 12 | 60:40 | 0-5-75(30) | none | hazy | Fail |
| 13 | 70:30 | 0-38-42(30) | none | cloudy | Fail |

Comparative sample 11 is a commercially available blend of butanol-initiated propoxylate and pentaerythritol ester (Ultracoolant SSR ex Ingersol Rand).

Comparative sample 12 is a commercially available blend of butanol-initiated propoxylate and adipate diester (Sullube 32 ex Sullair).

Comparative sample 13 is a blend of butanol-initiated propoxylate and a tetra ester of pentaerythritol and 2-ethyl hexanoic acid.

Example 1 demonstrates that lubricant compositions in accordance with the invention do not form stable emulsions with water in contrast to the known compositions of Example 2.

It was observed that samples 1 and 2 had a greater tendency to foam than comparative sample 11. It was found that such foaming could be controlled, whilst achieving similar demulsibility results, by the addition of a commercially available non-silicone antifoaming agent, Additin RC 8301 ex Rhein Chemie. Samples 2 and 3 represent an equivalent blend composition where sample 3 has the additional presence of 50 ppm non-silicone antifoaming agent.

EXAMPLE 3

The effect of water on the viscosity and corrosivity of sample 3 and comparative sample 11 was measured using the Beverage Bottle test (based on a modified version of ASTM D2619). 75 g sample and 25 g water were sealed in a beverage bottle with a polished copper test specimen. The bottle was then rotated at 5 rpm for 2 weeks at a temperature of 93° C. The changes in viscosity and acid value of the mixture of 75 g sample and 25 g water were measured.

The viscosity ($mm/s^2$ at 40° C.) was reduced by 3.1 in the case of comparative sample 11 whereas for sample 3 the viscosity reduction was only 0.6. Similarly, the acid value mgKOH/g changed to a greater extent for comparative sample 11 (0.54) than for sample 3 (0.01).

EXAMPLE 4

To assess the take up of water, sample 3 and comparative sample 11 were dried using a nitrogen purge until the water content measured 100 ppm. The samples were then placed in dessicators at 75° C. and the water content measured at intervals.

For both the samples, the water content rose steadily until reaching a constant level after circa 30 days. However, whereas the water content of comparative sample 11 was circa 6000 ppm, the content of sample 3 was only 4000 ppm.

Examples 3 and 4 illustrate that the specific blends of polyalkylene glycol and ester of the invention are less susceptible to the effect of water and do not absorb water as readily as blends of known polyalkylene glycol and ester.

EXAMPLE 5

In respect of miscibility with mineral oil comparative sample 11 and sample 2 were tested. Comparative sample 11 was found to be only miscible with oil at a 10% content whereas sample 2 was miscible up to a content of 25%.

EXAMPLE 6

In respect of low temperature fluidity, measured as the pour point, i.e. the minimum temperature at which the lubricant could be poured, samples 1, 2, and 3 and comparative sample 12 were tested. Samples 1, 2 and 3 were found to have lower pour points (−42° C.) than comparative sample 12 (−38° C.).

What is claimed is:

1. An air compressor lubricated with a lubricant composition comprising:

(1) a polyalkylene glycol having the formula $$RO—(CH_2CH(CH_3)O)_n—CH_3$$

where R is an alkyl group with 1–15 carbon atoms and n=1 to 35; and (2) a polyol ester.

2. The air compressor of claim 1, wherein R is an alkyl group with 1 to 4 carbon atoms.

3. The air compressor of claim 1 wherein n=8 to 30.

4. The air compressor of claim 1 wherein an antifoaming agent in the range 2 to 100 ppm is additionally present.

5. The air compressor of claim 1 wherein said polyol ester is an ester of pentaerythritol.

6. The air compressor of claim 1 wherein said polyalkylene glycol and polyol ester are present in a weight ratio of about 70:30.

* * * * *